US005273218A

United States Patent [19]

Burns

[11] Patent Number: 5,273,218

[45] Date of Patent: Dec. 28, 1993

[54] FALCON HOG

[76] Inventor: Leslie L. Burns, 4764 Palomino Ct., Salem, Oreg. 97301

[21] Appl. No.: 811,883

[22] Filed: Dec. 19, 1991

Related U.S. Application Data

[63] Continuation of Ser. No. 568,667, Aug. 20, 1990, abandoned.

[51] Int. Cl.[5] ..... B02C 13/06; B02C 13/28

[52] U.S. Cl. ..... 241/32; 241/73; 241/189.1; 241/242; 241/285.3

[58] Field of Search ..... 241/32, 73, 88.4, 189.1, 241/285.3, 294, 242, 235

[56] References Cited

U.S. PATENT DOCUMENTS

| | | | |
|---|---|---|---|
| 1,801,604 | 4/1931 | Jamison | 241/285 B X |
| 1,877,121 | 9/1932 | Borton | 241/32 |
| 2,807,424 | 9/1957 | Records | 241/285.1 X |
| 3,357,467 | 12/1967 | Morkeski | 241/32 |
| 3,473,742 | 10/1969 | Montgomery | 241/32 |
| 3,700,176 | 10/1972 | Haber | 241/257 R X |
| 3,701,485 | 10/1972 | Kimble et al. | 241/189 R X |
| 3,887,141 | 6/1975 | Francis | 241/189 R X |
| 4,073,444 | 2/1978 | Pav | 241/285.3 X |
| 4,151,959 | 5/1979 | Deisler | 241/69 |
| 4,151,960 | 5/1979 | Peterson, Jr. | 241/285 B X |
| 4,161,296 | 7/1979 | Parker et al. | 241/235 X |
| 4,164,329 | 8/1979 | Higby | 241/296 X |
| 4,175,710 | 11/1979 | Robertson | 241/285.3 X |
| 4,198,005 | 4/1980 | Eiff | 241/285 B X |
| 4,205,799 | 6/1980 | Brewer | 241/285.3 X |
| 4,261,523 | 4/1981 | LaPointe | 241/285.3 X |
| 4,394,983 | 7/1983 | Ulsky | 241/285.3 X |
| 4,545,539 | 10/1985 | Steffensen | 241/73 |
| 4,706,898 | 11/1987 | Schönfeld et al. | 241/285 B X |
| 4,919,344 | 4/1990 | McKie | 241/32 |
| 5,092,529 | 3/1992 | Bechler et al. | 241/294 X |
| 5,165,611 | 11/1992 | Ragnarsson | 241/191 X |

FOREIGN PATENT DOCUMENTS

| | | | |
|---|---|---|---|
| 3734999 | 10/1988 | Fed. Rep. of Germany | 241/285 B |
| 3807983 | 9/1989 | Fed. Rep. of Germany | 241/235 |
| 1407539 | 7/1988 | U.S.S.R. | 241/235 |

*Primary Examiner*—Mark Rosenbaum
*Assistant Examiner*—Frances Chin
*Attorney, Agent, or Firm*—Charles N. Hilke

[57] ABSTRACT

An apparatus for reducing various material to smaller sizes emphasizing large volume with long pieces. The apparatus has a frame case, with an infeed and outfeed, within which at least one rotor with at least one radially tilted forward cutter bar cuts the material against one anvil. A grate is used to size the material to final product dimensions. The frame case is angularly split. Where more than one rotor is used, they are radially offset.

11 Claims, 4 Drawing Sheets

FALCON HOG

This is a continuation of co-pending application Ser. No. 568,667 filed on Aug. 20, 1990 abandoned.

BACKGROUND OF THE INVENTION

Prior Art

A three impact bar rock crusher as shown in U.S. Pat. No. 3,701,485 shows the 120° degree offset between bars to get the material to be crushed into the machine. The action is one which the bar strikes the material in mid-air and flings the material against an anvil. U.S. Pat. No. 3,887,141 shows another version of a rock crusher which uses parallel impact bars and flings are material for impact reduction.

Diester U.S. Pat. No. 4,151,959 again strikes the material in mid-air but also moves the material laterally along the axis of the shaft. The material is reduced by impact with the striker plates, with the inside of the case, with each other and with the anvil. The striker plates are angled slightly backwards to give the flinging action and the striker plates are angled (15°) from the shaft axis to give the spiral movement. The Diester apparatus has limited volume. In order to get the spiral movement of material the infeed is limited to one side of the machine. Particle size is difficult to control and larger sizes are most difficult to do.

In general hammer hogs contain a plurality of pivoted hammers on the outer rotor dimension. The hammers pulverize the material against an anvil. The rotor is light and the hammers are heavy. The rotor tends to be difficult to start because the pivoted hammers hang towards the bottom of the machine. Bearing wear is high and maintenance is excessive.

Knife hogs have fixed knives on a spinning rotor. The knives are generally sharpened every four hours which adds downtime and expense.

Shredders generally have low rotating speed with high torque which requires an expensive gear reduction system. The anvil has teeth through which each shredder tooth moves. Particle size is difficult to control. Volume is very low because of slow rotation speed.

SUMMARY OF THE INVENTION

A drive motor turns a shaft to which at least one rotor is fixably attached. The infeed hole is angularly disposed to accept longer pieces of material. An anvil is set perpendicular to the infeed hole such that material from an infeed conveyor falls directly on said anvil. The rotor has at least one radially tilted forward cutter bar which cuts the material as it slides down the anvil. The rotor generally has three or, sometimes, four tilted forward cutter bars and rotates at 500 to 1000 rpm. Each time a titled forward cutter bar passes the anvil, a piece is out off the material and carried to the grate. The grate begins at the bottom point of the anvil and continues for 180° degrees around the rotor. A plurality of holes are located on the grate to allow proper particle sizing. Material too large for the hole is sheared by the cutter bar and back of hole until all pieces drop through the grate. The vast majority of material will exit the grate without returning to the anvil section.

More than one rotor can be used. When more than one rotor is used, the rotors are welded together but in a position so that each tilted forward cutter bar is offset from the nearest radially tilted forward cutter bar of the adjacent rotor.

DESCRIPTION OF THE PREFERRED EMBODIMENT

Figure 1:
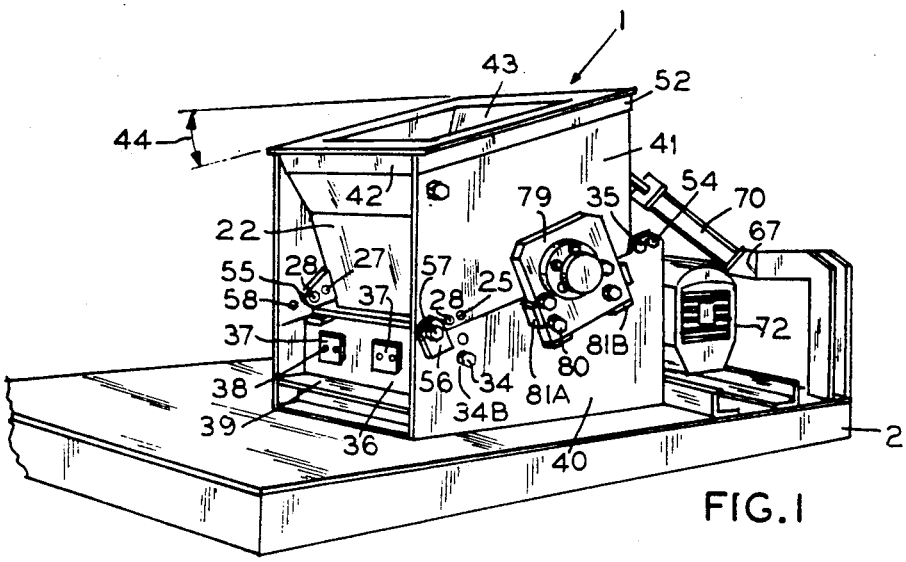
FIG. 1 is a perspective view of the material size reduction machine.
Figure 2:
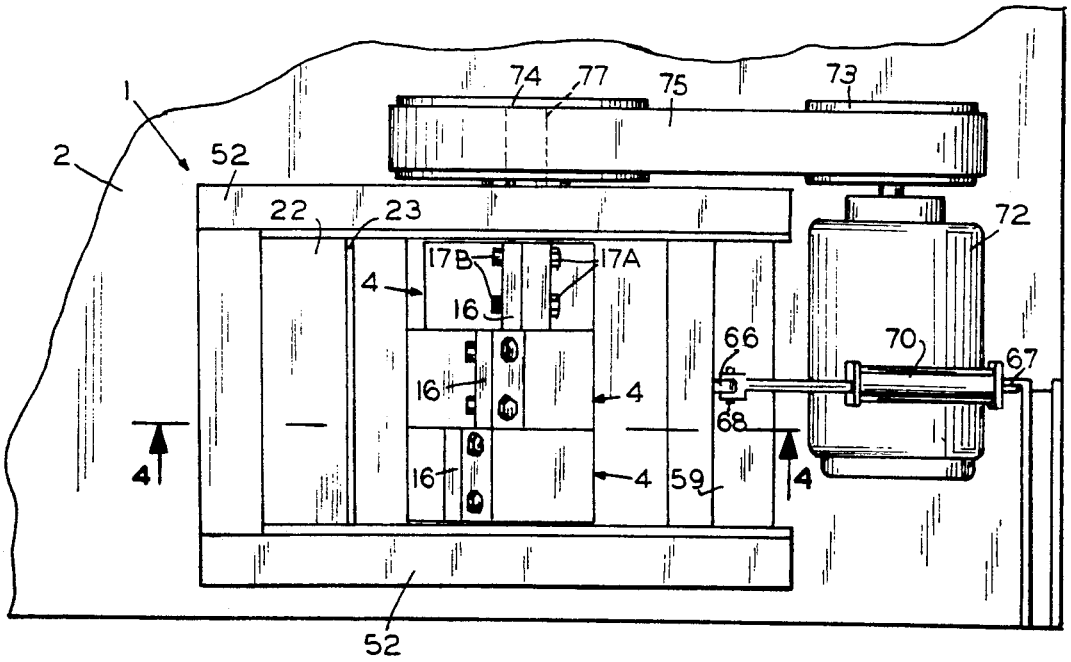
FIG. 2 is a top view of the material size reduction machine.
Figure 3:
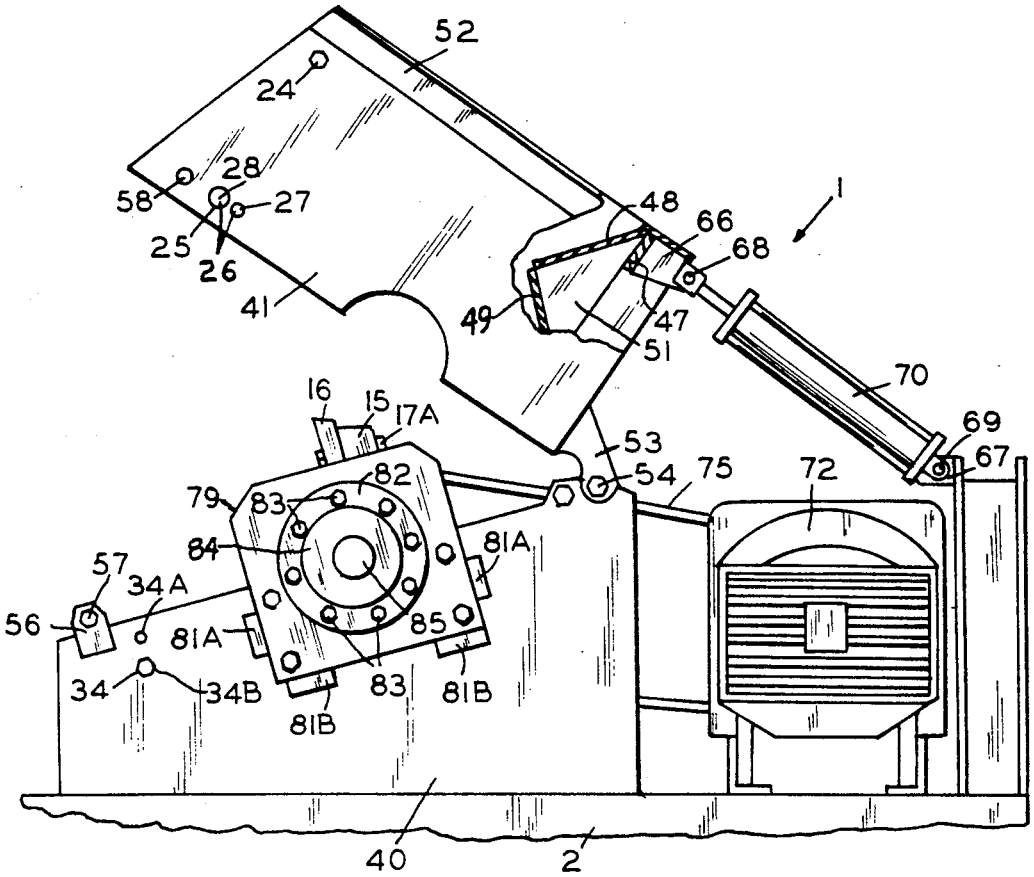
FIG. 3 is a side view showing the material size reduction machine opened.
Figure 4:
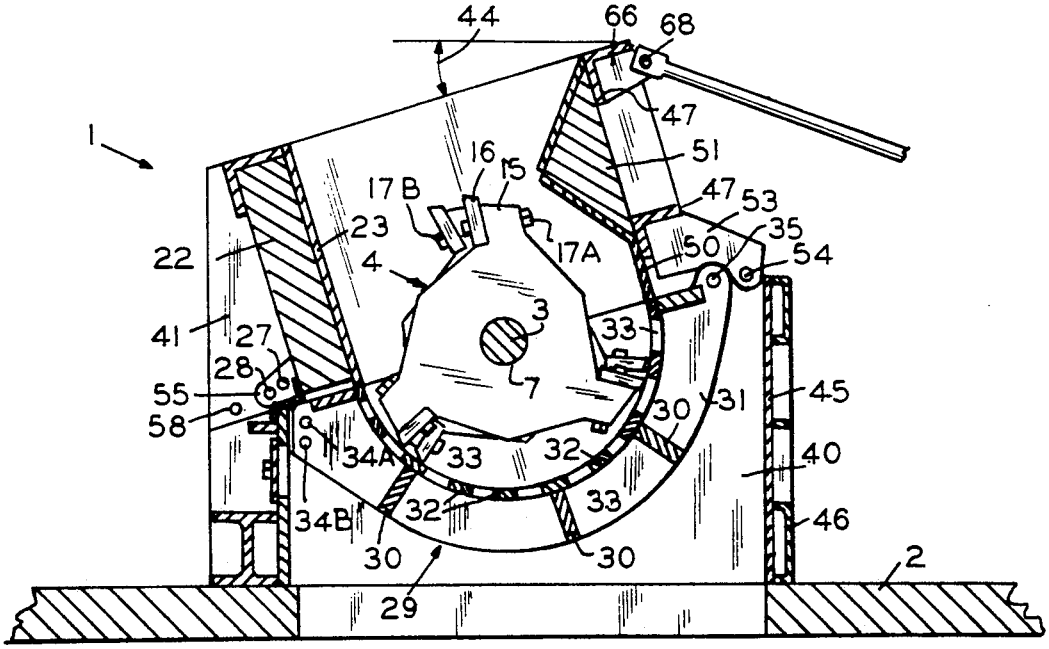
FIG. 4 is a side section view along lines 4—4 of FIG. 2.
Figure 5:
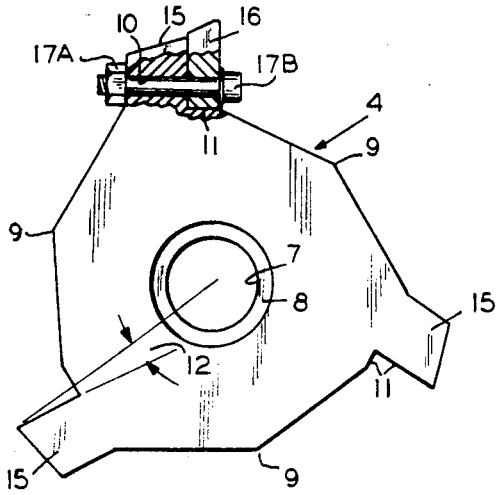
FIG. 5 is a side view of the rotor with a cut-away view of the tilted forward cutter bar.
Figure 6:
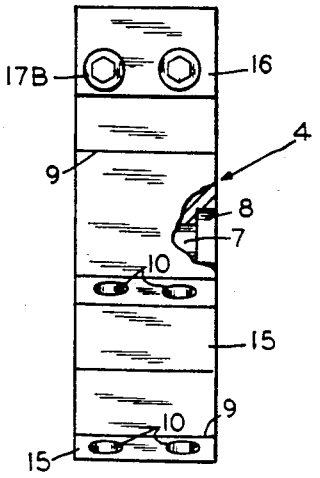
FIG. 6 is a front view of the rotor with a cut-away view of the shaft.

Reviewing FIGS. 1, 2, 3, 4, 5, 6, 7, and 8, a material size reduction machine 1 rests on a base framework 2. A rotor 4 or plurality of rotors 4 fit on shaft 3. If there is a plurality of rotors 4 there is a rotor weld 5 between the rotors as indicated. Each rotor 4 contains a rotor shaft hole 7 which is 0.004 inches greater diameter than the shaft diameter 3. In each outside rotor 4 a ring feder counterbore 8 is drilled so that the ring feder 6 will properly attach the rotor 4 to the shaft 3. The ring feder 6 is attached to the rotor 4 and the shaft 3 by means of ring feder bolts 15. The rotor 4 is hexshaped 9 in order to increase the mass of each rotor 4. Two cutter bar holes 10 are drilled through each cutter bar seat 11. While three cutter bar seats 11 are shown in some larger machines the number of cutter bar seats may increase to four. The cutter bar seat angle 12 is shown along with the cutter bar angle of attack 13.

Figure 11:
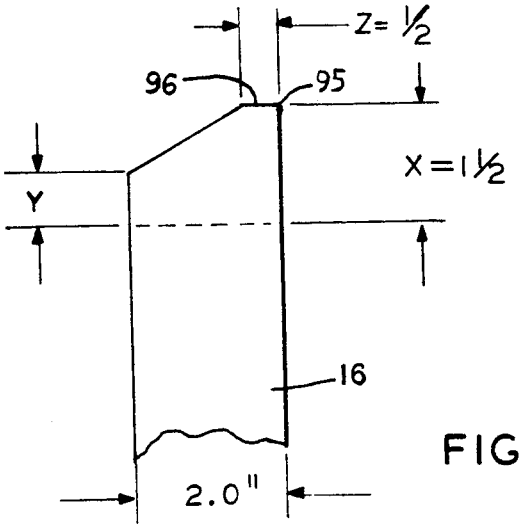
FIG. 11 is a schematic view showing the dimensions of the cutter bar.

Finally, the cutter bar seat radial angle 14 is shown. However, the cutter bar seat radial angle 14 may vary with different rotor diameters. Cutter bar 16 is attached to the cutter bar seat 11 by means of the cutter bar attachment nuts 17A and cutter bar socket head cap screws 17B. The cutter bar dimensions in FIG. 11 are generally a two-inch thick plate with a top measurement of Y of ¾ inches and a base measurement of X inches equal to one-and-a-half inches. Generally dimension Z is a half an inch. The angle of the cutter bar relief is 45 degrees.

The anvil 22 also forms the front side of the upper case. The anvil wear plate 23 is shown. The anvil 22 contains anvil pivots 24 which are threaded on side plates but pegged into the anvil 22. The anvil shear pins 25 are shown along with the anvil shear holes 26. There are two anvil shear holes 26, one set at one-eighth inch 27 and the other set at three-eighths inches 28. Two shear pins 25 and two pivots 24 are used, one on each side of the machine 1.

The grate assembly 29 generally will comprise five gate bars 30 with two grate side plates 31. A grate liner 32 will be provided which includes liner holes 33 within the grate liner 32. The grate adjustable shear pin 34 may be placed in either 34A which is the one-eighths-inch shear hole or 34B which is the three-eighths-inch shear hole. The grate pivot pin 35 is shown. The lower case front plate 36 is shown with an access plate 37 for shear pin 34 attached by means of access plate bolts 38. Structural beam lower case front 39 is shown along with the lower case side plates 40 and the upper case side plates 41. The upper case front structural angle 42 is shown. The in-feed hole 43 contains the in-feed hole angle 44. Two shear pins 34 and two pivots 35 are used, one on each side of the machine 1.

The lower case back plate 45 along with the lower case back structural channels 46 of which there are two and the upper case back structural angles 47 of which there are two are shown. The back deflector plate 48 is shown along with the return deflector plate 49. The upper case lower back plate 50 and gussets 51 are shown along with the upper case side structural angles 52. The hinge bracket 53 is shown with the upper case pivot pin 54. Side hinge tab 55 is shown. The connection plate 56 along with the connection plate bolt 57 and the upper case connection bolt hole 58 are illustrated. The hinge cover plate 59 is shown.

The upper mounting bracket 66 and frame mounting bracket 67 are shown with the upper mounting bracket pivot 68 and the frame mounting bracket pivot 69. The hydraulic cylinder 70 is shown and it contains a safety check valve. In addition, the usual hydraulic features of an operating valve, hydraulic power supply, hydraulic pump, and hydraulic reservoir are utilized but not shown. The drive motor 72 is shown with the drive sheave 73 and the driven sheave 74. The drive belt 75 is shown between the sheaves and ordinarily a safety drive guard is provided for safety reasons. The shaft drive portion 77 is shown. To mount the shaft 3 on the material size reduction machine 1 the bearing mounting block 79 is attached to the sides by bearing mounting block bolts 80. Bearing mounting stops 81A (side) and 81B (base) are used to stabilize the bearing mounting block 79. The bearing housing 82 is attached by means of the bearing housing bolts 83. The bearing 84 is a dual spherical roller bearing in a piloted flange housing. The bearing cap 85 is shown.

Figure 9:
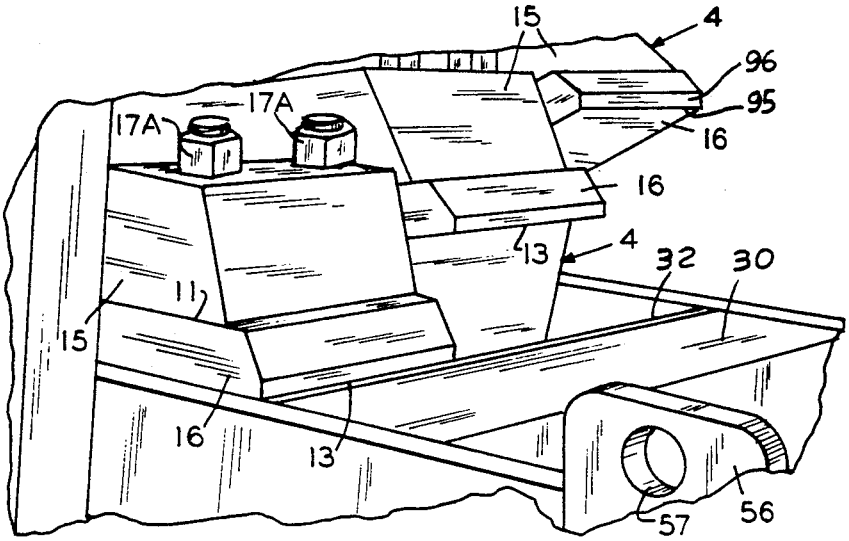
FIG. 9 is a side perspective view of the relationship between the cutter bar and grate.

FIG. 9 is a perspective view showing that the cutter bar 16 is parallel to the leading edge of the grate liner 32. From FIG. 4, the bottom edge of the anvil 22 is parallel to the leading edge of the grate liner 32. Thus, the cutter bar 16 is parallel to the anvil 22. This can also be seen by viewing the line 95 formed by the intersection of the bottom surface of the cutter bar 16 and the surface 96 of dimension X shown in FIGS. 11, 9 and 4. From FIG. 5 and FIG. 9, the longest side of the five sided cutter bar is on a radial plane extending from the centerline of the shaft.

Figure 7:
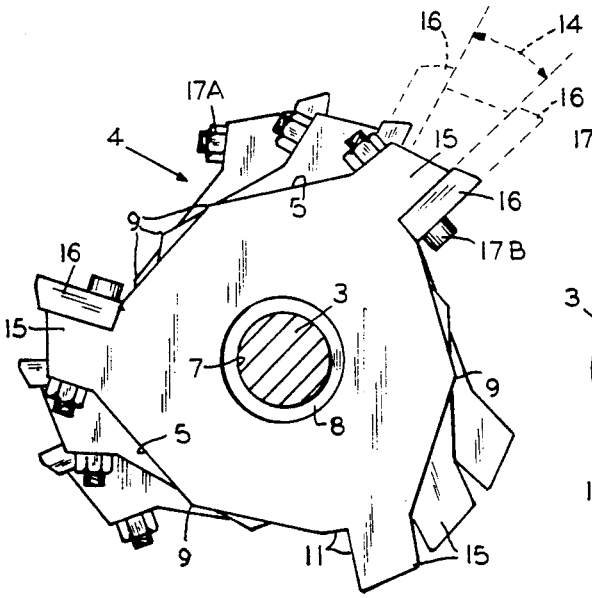
FIG. 7 is a side view of a plurality of rotors with ghost lines showing a larger size rotor.
Figure 8:
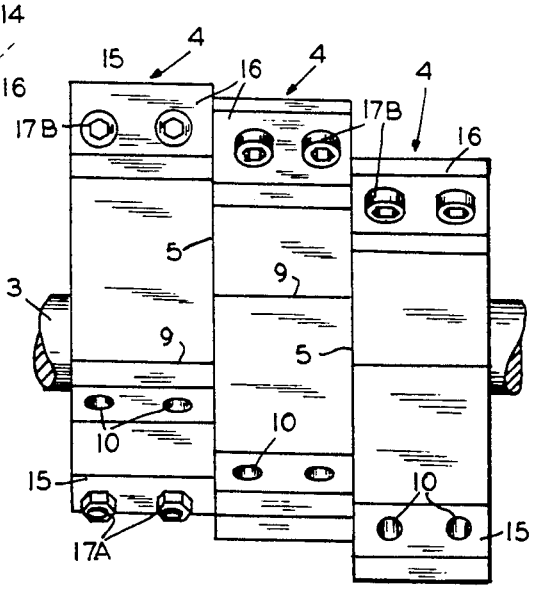
FIG. 8 is a front view of a plurality of rotors.
Figure 10:
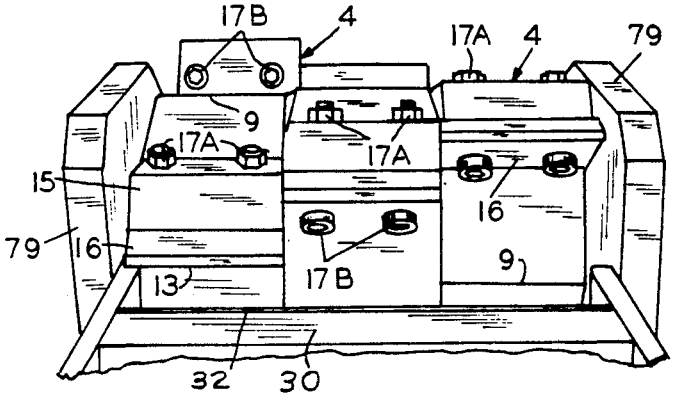
FIG. 10 is a front view showing the angle between the cutter bar and the grate.

FIGS. 7 and 10 show that cutter bar 16 is parallel to the length of the grate 32. The entire longest side of each five sided cutter bar cuts the material at the same time against the anvil. In other words, there is no angle as, for example, in a scissors cutting movement or in an attempt to move material laterally along the sections of the rotor.

In operation, the material to be reduced will generally fall from a feed conveyor into the infeed hole 43 of the machine 1. Generally, when starting the outfeed conveyor is started first, then the machine 1, and finally the infeed conveyor. The machine 1 is started by operating the drive motor 72 so that the drive sheave 73 turns the drive belt 75 which operates the driven sheave 74 attached to the shaft drive portion 77 of the shaft 3. The shaft 3 turns the rotors 4.

When the material falls into the infeed hole 43, an infeed hole angle 44 allows for longer length material to enter the machine 1. The infeed hole angle 44 is equal to the angle of the split case.

The anvil 22 with anvil plate 23 is perpendicular to the infeed hole angle 44. The speed of infeed conveyor is such that most, if not all, of material to be reduced will land and slide down the anvil wear plate 23. In general, the angle of the anvil 22 will vary between 45° and 80° as measured from the horizontal. The rotor 4 is turned between 500 rpm and 1000 rpm. Depending on the thickness of the material, the tilt forward cutter bar 16 will cut a portion off of the material. If the portion of material is less than ⅛" or ⅜" depending on the positioning of the anvil 22, it will slide through the space between the anvil 22 and the tilt forward cutter bar 16. The cutter bar angle of attack 13 creates a cutting action rather than a crushing action. The cutting action is more efficient than a crushing action in that less power is required. The offset reduces the power requirements on larger material because only one tilt forward cutter bar 16 is fully engaged at any one time. No flinging action takes place to shatter the material against the anvil 22 because of the angle of the anvil 22 created by the infeed hole angle 44 and the tilted forward cutter bar angle of attach 13. If the material is larger than the ⅛" or ⅜", the material is sliding downward on the anvil wear plate 23. Other tilt forward cutter bars 16 on the same rotor 4 or other rotors 4 will continue to cut the material to approximately 4 inch minus (4 inches or less). The cut material is then carried into the grate section of the machine. The material is moved along the grate line 32 until it falls into liner holes 33. The liner holes 33 vary in size depending on final product size. Larger holes allow for larger size; smaller holes, small size. If the material is larger than the liner hole 33, a portion will fall into the hole 33 and the tilt forward cutter bar 16 uses the back edge of the hole 33 to out the material. This action continues until the material is reduced to the desired dimensions. Once cut, the material drops out the outfeed along the full width of the rotors 4 onto an outfeed conveyor.

I claim:

1. An apparatus comprising:

a frame case;

an infeed;

a shaft mounted on bearings;

at least two rotors mounted on said shaft;

at least one rotor cutter bar support extending from each said rotor at an angle from a radial line extending from the centerline of said shaft;

at least one radially tilted forward cutter bar having five sides and being parallel to said shaft centerline and is attached to said rotor cutter bar support where each radially tilted forward cutter bar of one rotor is radially offset from each radially tilted forward cutter ar of another rotor and where a longest side of the five sides of said radially tilted forward cutter bar is on a radial plane extending from the centerline of said shaft;

at least one anvil;

a grate for sizing the material;

an outfeed the full width of said rotors; and a drive motor.

2. The apparatus of claim 1 wherein said anvil contains at least two shear pins with at least two pivots.

3. The apparatus of claim 1 wherein said action of said radially tilted forward cutter bar with respect to said anvil is a cutting action.

4. The apparatus of claim 1 where said rotor is 11 and ¾ inches wide.

5. The apparatus of claim 1 where a cutter bar seat angle of said rotor cutter bar support is 10 degrees.

6. The apparatus of claim 1 where said grate contains at least two shear pins and at least two pivots.

7. The apparatus of claim 6 where said shear pins and pivots are separate from a case hinge.

8. The apparatus of claim 1 additionally comprising an angularly split frame case.

9. The apparatus of claim 8 where said bearings are attached to a bearing mounting block only fixably attached to the bottom portion of said angularly split frame case.

10. The apparatus of claim 8 wherein said anvil is perpendicular to the angle of the split frame case and parallel to said radially tilted forward cutter bars.

11. The apparatus of claim 10 where said grate begins at bottom point of said anvil and continues for 180 degrees around said rotor.

* * * * *